United States Patent [19]

Jessup et al.

[11] Patent Number: 4,723,964

[45] Date of Patent: Feb. 9, 1988

[54] CETANE NUMBER IMPROVEMENT

[75] Inventors: Peter J. Jessup, Santa Ana; Diane M. Dillon, Fullerton; Stephen G. Brass, Fullerton; Michael C. Croudace, Huntington Beach, all of Calif.

[73] Assignee: Union Oil Company of California, Los Angeles, Calif.

[21] Appl. No.: 811,957

[22] Filed: Dec. 20, 1985

[51] Int. Cl.[4] ..... C10L 1/10

[52] U.S. Cl. ..... 44/57; 44/56; 44/64

[58] Field of Search ..... 44/57, 64, 56

[56] References Cited

U.S. PATENT DOCUMENTS

| | | | |
|---|---|---|---|
| 2,027,394 | 1/1936 | McMullan | 44/57 |
| 2,115,275 | 4/1938 | Moran et al. | 44/9 |
| 2,136,455 | 11/1938 | Moran | 44/57 |
| 2,188,262 | 1/1940 | Crandall | 44/9 |
| 2,225,879 | 12/1940 | Miller et al. | 44/9 |
| 2,382,904 | 8/1945 | Pedersen | 44/64 |
| 2,392,611 | 1/1946 | Nygaard et al. | 44/57 |
| 2,877,102 | 3/1959 | Levesque | 44/57 |
| 3,479,163 | 11/1969 | Vogelfanger | 44/64 |
| 3,869,453 | 3/1975 | Bennett | 44/57 |
| 4,280,819 | 7/1981 | Hartle et al. | 44/64 |
| 4,303,414 | 12/1981 | Frankel et al. | 44/63 |
| 4,365,973 | 12/1982 | Irish | 44/56 |

FOREIGN PATENT DOCUMENTS

| | | | |
|---|---|---|---|
| 0379725 | 8/1932 | United Kingdom | 44/57 |

OTHER PUBLICATIONS

"Cetane Number", Gruse, W. A., *Motor Fuels Performance and Testing,* Reinhold Publishing Corp., N.Y., 1967, p. 153.

*Practical Catalytic Hydrogenation,* Freifelder, M., Wiley Interscience, N.Y. 1971, pp. 168–169 and 208–210.

*Primary Examiner*—William R. Dixon, Jr.
*Assistant Examiner*—Margaret B. Medley
*Attorney, Agent, or Firm*—Dean Sandford; Gregory F. Wirzbicki; Robert A. Franks

[57] ABSTRACT

Liquid hydrocarbon fuels having an enhanced cetane number include at least one azo compound having the formula:

$$R_1N{=}NR_2$$

wherein $R_1$ and $R_2$ are the same or different organo groups, each containing 1 to about 10 carbon atoms.

44 Claims, No Drawings

CETANE NUMBER IMPROVEMENT

BACKGROUND OF THE INVENTION 1. Field of the Invention

This invention relates to liquid hydrocarbon fuels having improved ignition characteristics, more particularly to diesel fuels with enhanced cetane numbers. 2. Description of the Art Fuel ignition in diesel engines is achieved through the heat generated by air compression, as a piston in a cylinder moves to reduce the cylinder volume during a compression stroke. In the engine, the air is first compressed, then fuel is injected into the cylinder; as fuel contacts the heated air, it vaporizes and finally begins to burn as the self-ignition temperature is reached. Additional fuel is injected during the compression stroke and this fuel burns almost instantaneously, once the initial flame has been established.

Thus, a period of time elapse between the beginning of fuel injection and the appearance of a flame in the cylinder. This period is commonly called "ignition delay" and must be quite short to avoid "diesel knock," which is caused by the accumulation and detonation of relatively large amounts of fuel before the desired smooth combustion process has been established.

A reduction in ignition delay can be obtained by varying the chemical nature of the injected fuel. Straight-chain paraffinic hydrocarbons give the least ignition delay, while branched-chain paraffins and cyclic (including aromatic) compounds tend to have poorer ignition characteristics. For this reason, n-hexadecane ("cetane"), which is diesel fuel having excellent ignition qualities, has long been used as a standard reference material for determining the ignition quality of commercial diesel fuels. A scale called "cetane number" has been devised for ranking the relative ignition delay characteristics of a given diesel fuel. The cetane number of an unknown fuel is determined by comparing its ignition delay in a standard test engine with reference fuels which are prepared by blending cetane (assigned a rating of 100) and 2,2,4,4,6,8,8,-heptamethyl nonane (assigned a rating of 15) until a reference fuel is found to have the same ignition delay characteristics as the unknown fuel; the cetane number is obtained by the equation:

Cetane No. = volume % cetane + 0.15 (volume % heptamethylnonane)

In general, large stationary engines which run at fairly constant speeds and loads have the lowest cetane number requirements (e.g., 30 to 45), while smaller, motor vehicle diesel engines have the highest requirements (e.g., 40 to 55) for obtaining optimum performance. In addition to decreasing ignition delay, a higher cetane number fuel facilitates low temperature starting, provides smoother engine operation, and decreases engine deposits.

A modern petroleum refinery can produce high quality diesel fuels with large straight-chain paraffin contents. However, due to competing demands for other products, limitations imposed by poor quality heavy crude oils, and other factors, a refinery frequently is unable to meet the total demand for such diesel fuels. Because of these refining constraints, various additives have been used to increase the cetane number of diesel fuels, thereby permitting a refiner to produce larger volumes of fuel which, without additives, would not be acceptable to some consumers.

Moran et al., in U.S. Pat. No. 2,115,275, describe diesel fuels which have a reduced tendency to exhibit knocking, prepared by mixing a trizo compound with the fuel.

U.S. Pat. No. 2,188,262 to Crandall is directed to diesel fuel compositions which have improved ignition characteristics, due to the presence of a pentazdiene additive.

Miller et al. in U.S. Pat. No. 2,225,879, teach that cetane number increases are obtained by adding to diesel fuel organic compounds having a diazo group and a carboxy group in the same molecule.

U.S. Pat. No. 4,280,819 to Hartle et al. discloses an improvement in the cetane number rating of diesel fuel by adding thereto certain aromatic azide compounds.

Frankel et al., in their U.S. Pat. No. 4,303,414, describe additives which increase the octane rating of gasoline, enhance the centane rating of diesel fuel, and provide other benefits to internal combustion engines. The additives are alkyl azides.

A middle distillate fuel additive is taught by Irish in U.S. Pat. No. 4,365,973. One component of the additive is a paraffinic nitrate or mixture of nitrates, included for the purpose of cetane improvement.

SUMMARY OF THE INVENTION

The invention provides a composition with improved cetane number ratings, comprising a liquid hydrocarbon fuel and an azo compound additive having the formula:

$$R_1N{=}NR_2$$

wherein $R_1$ and $R_2$ are the same or different organo groups. $R_1$ and $R_2$ can each be branched or unbranched acyclic groups, or cyclic groups, and can be saturated or unsaturated, and either substituted or unsubstituted.

The composition is prepared by blending the fuel and the additive, usually in proportions to provide at least about 0.05 percent by weight of additive in the product.

DETAILED DESCRIPTION OF THE INVENTION

In accordance with the invention there is provided a fuel composition which possesses an enhanced cetane number rating. This composition comprises a liquid hydrocarbon fuel, to which has been added an azo compound having the formula:

$$R_1N{=}NR_2$$

wherein $R_1$ and $R_2$ are the same or different organo groups, each preferably containing 1 to about 10 carbon atoms. An "organo" group, as used herein, is an acyclic group, heteroacyclic group, alicyclic group, aromatic group, or heterocyclic group.

The term "acyclic group," as used herein, means a substituted or unsubstituted acyclic group, including saturated and unsaturated aliphatics which can be straight chain or branched chain. The "aliphatics" include alkyl, alkenyl, and alkynyl.

The term "heteroacyclic group," as used herein, means an acyclic group containing one or more heteroatoms in the chain selected from oxygen, nitrogen, and sulfur. The heteroatoms can be the same or different in each chain and usually the number of heteroatoms is one, two, or three.

The term "alicyclic group," as used herein, means a substituted or unsubstituted alicyclic group. The term "alicyclic" includes saturated or unsaturated cyclic aliphatics.

The term "aromatic group," as used herein, means a substituted or unsubstituted aromatic group. The term "aromatic" includes phenyl, naphthyl, biphenyl, anthracyl, and phenanthryl.

The term "heterocyclic group," as used herein, means a substituted or unsubstituted heterocyclic or aromatic group containing one or more heteroatoms in the ring selected from oxygen, nitrogen, and sulfur. The heteroatoms can be the same or different in each ring and usually the number of heteroatoms is one, two, or three.

The terms "substituted acyclic," "substituted heteroacyclic," "substituted alicyclic," "substituted aromatic" and "substituted heterocyclic," as used herein, respectively means an acyclic, heteroacylic, alicyclic, aromatic, or heterocyclic group, substituted with one or more functions such as alkyl, alkenyl, alkynyl, alkoxy, alkenyloxy, alkynyloxy, alkylthio, alkenylthio, alkynylthio, halo, oxo, hydroxy, carbonyl, carboxyl, alkylcarbonyloxy, alkylcarbonyl, carboxyalky, thio, mercapto, sulfinyl, sulfonyl, imino, amino, cyano, nitro, hydroxyamine, nitroso, cycloalkyl, cycloalkylalkyl, aryl, arylalkyl, alkylaryl, aryloxy, arylalkoxy, alkylaryloxy, arylthio, arylalkylthio, alkylarylthio, arylamino, arylakylamine, and alkylarylamino.

A number of suitable azo compounds are available commercially. In addition, azo compounds can be prepared by methods known in the art, including the synthesis from aldehydes or ketones, with substituted hydrazines as intermediates, described by R. Renaud and L. C. Leitch, *Canadian Journal of Chemistry,* vol. 32, pages 545–549 (1954).

Another synthetic route involves the reaction of amines with sulfuryl chloride to form sulfamides, which can be oxidized to azo compounds. An example in the literature is J. C. Stowell, *Journal of Organic Chemistry,* Vol. 32, pages 2360–2362 (1967). A further literature report for this method is P. S. Engel and D. J. Bishop, *Journal of the American Chemical Society,* Vol. 94, pages 2148–2149 (1972).

To prepare the fuel composition, a desired azo compound or mixture of azo compounds is blended with a base fuel. Preferably, the azo compounds chosen are soluble in the fuel. If the desired additive is not sufficiently soluble, it will be necessary to use a consolvent for the additive and the fuel; typically, the additive will be dissolved in the cosolvent and the resulting solution will be blended with the fuel.

Useful amounts of additive in the base fuel are about 0.05 to about 10 percent by weight. Preferred amounts are about 0.05 to about 5 percent by weight, with most preferred amounts being about 0.1 to about 2 percent by weight. The upper limit of these ranges will be determined primarily by solubility of the additive in a fuel and by the cost of the additive, since large amounts of additive can increase the cost of producing the fuel of the invention to unacceptable levels.

Test results indicate that the cetane-enhancing effect of adding azo compounds to fuels may not be linear, i.e., adding twice as much additive may not double the cetane rating increase. In general, it appears that the largest increases in cetane number for each incremental increase in azo compound concentration occur within the "most preferred" range given above.

Fuels which are blended with azo additives are generically "middle distillates," obtained from feedstocks which are either natural or synthetic liquid hydrocarbons. Natural liquid hydrocarbons suitable for use as a feedstock include crude petroleum, shale oil, and tar sand bitumen. Synthetic liquid hydrocarbons which are useful as feedstocks include those derived from coal materials, peat, agriculatural products (such as vegetable oils), and coke. Cetane number improvement is normally only important for diesel fuels, which typically have a flash point above about 100° F., and a specification for 90 percent of the fuel to be distilled at temperatures below about 675° F.

Diesel fuels usually contain other additives, for the purposes of modifying the structure of wax crystals which form at low temperatures (to prevent filter plugging), viscosity modification (to maintain flowability at low temperatures), the prevention of icing from water contained in the fuel, preventing microbial growth, and others. Also, there is a trend toward the use of alcohol-containing fuels in diesel engines. The use of azo compounds in fuels which also contain other additives is specifically contemplated herein.

The invention is further illustrated by the following examples which are illustrative of various aspects of the invention and are not intended as limiting the scope of the invention as defined by the appended claims.

EXAMPLE 1

The preparation of 2,2'-azobispropane (azoisopropane) is described.

A solution of acetone (107.7 g, 1.856 moles) in 200 ml of diethyl ether is placed in 1-liter round bottom flask, equipped with a condenser and addition funnel and immersed in an ice bath. To the flask is added hydrazine (56.7 g, 0.974 moles) in the form of a 55 percent by weight aqueous peiction. This addition is made over a period of 0.5 to 1 hour, while vigorously stirring the flask contents with a magnetic stirring bar. The flask is allowed to warm to room temperature overnight, while the stirring is maintained When stirring is discontinued, the ether layer is removed. The aqueous layer is washed with about 200 ml of diethyl ether and both of the ether solutions are combined, dried over anhydrous sodium carbonate, filtered, and evaporated under vacuum. Residue from the evaporation is distilled at 90° to 94° C., to recover an equimolar adduct of acetone and hydrazine (31.97 g, or 24 percent yield), and then at 127° to 132° C. to recover isopropylideneazine (67.03 g, or 64.5 percent yield), the adduct of one mole hydrazine and two moles acetone.

A 2-liter round-bottom flask, equipped with a condenser, an addition funnel, a heating mantle, a magnetic stirrer, and a means for maintaining an inert (nitrogen) atmosphere, is charged with 600 ml of a 1 molar lithium aluminum hydride solution in diethyl ether. With constant stirring, isopropylideneazine (67 g. 0.60 moles) is added dropwise over about 30 minutes, at a rate which generates sufficient reaction heat to cause a continuous reflux of ether. Following the addition, the heating mantle is used to maintain a temperature about 80° C., for about 2 hours. The reaction mixture is cooled to room temperature and 250 ml of a 40 weight percent aqueous potassium hydroxide solution are added dropwise, with vigorous stirring, over about 2 hours.

The ether layer is decanted through glass wool and the aqueous layer is washed with two 100 ml portions of diethyl ether. After combining the ether solutions and drying the mixture over potassium oxide pellets for 1 hour, a vacuum is applied to evaporate the ether. Distillation at 119° to 125° C. is employed to recover 1,2-diisopropylhydrazine (43.51 g, or 56 percent yield).

Yellow mercuric oxide (86.7 g, 0.38 moles) and 160 ml water are placed in a 1-liter round-bottom flask, equipped with a mechanical stirrer. With constant stirring, 1,2-diisopropylhydrazine (43 g, 0.37 moles) dissolved in 190 ml water, is added dropwise over about 1 hour. Following this addition, the mixture is distilled and the fraction boiling between 73° and 95° C. is collected. The organic layer of the collected product is separated from the aqueous layer and is dried over anhydrous magnesium sulfate, then is distilled at 88° to 89° C. to recover 2,2'-azobispropane (29.3 g, or 69.5 percent yield).

This method is useful for preparing azo compounds having nitrogen atoms bonded to terminal or secondary carbon atoms.

EXAMPLE 2

The preparation of azo-1,1'-bis (1,1-dimethylprop-2-yne) is described.

1,1-dimethylpropargylamine is dried over anhydrous sodium carbonate and 270 g (3.248 moles) of the dried material are charged to a 5-liter round-bottom flask with 1,200 ml n-pentane. The flask is immersed in an ice bath, equipped with a condenser, an addition funnel, and a magnetic stirrer, and then 200 ml of n-pentane containing sulfuryl chloride (109.8 g, 0.814 moles) are added dropwise, with vigorous stirring, over a 1 hour period. The flask is removed from the ice bath and stirring is continued for 2 hours at room temperature. A white precipitate is recovered by filtration, is washed with three 500 ml portions of water, is dried overnight under vacuum, and is identified as N,N'-1,1'-di (1,1-dimethylprop-2-yne) sulfamide (47.17 g, or 25.4 percent yield).

N,N'-1,1'di(1,1-dimethylprop-2-yne) sulfamide (47 g, 0.206 moles), sodium hydroxide (16.5 g, 0.412 moles), sodium hypochlorite (292.3 g of a 10.5 weight percent aqueous solution, 0.412 moles), and 500 ml n-pentane are placed in a 1-liter Ehrlenmeyer flask. The flask is immersed in an ice bath and its contents are stirred vigorously with a mechanical stirrer for 3 hours, then warmed to room temperature as stirring continues for an additional 2 hours. The pentane layer is separated and combined with two 200 ml volumes of pentane, used to wash the aqueous layer. After drying the pentane solution over anhydrous sodium carbonate, it is filtered and 200 g of toluene are added. Vacuum is applied to evaporate pentane, giving 182 g of a 10 percent by weight solution of azo-1,1'bis(1,1-dimethylprop-2-yne) in toluene.

This method is particularly useful for preparing azo compounds which have nitrogen atoms bonded to tertiary carbon atoms, which compounds cannot be prepared by the method of Example 1. However, compounds which can be prepared by the method of Example 1 may also be prepared by the above-described method.

It should be noted that the compound of this example undergoes spontaneous combustion in air, when the pure compound is heated above 40° C.; it is necessary to maintain the compound in solution and avoid heating the solution above room temperature. For preparing a more stable compound, such as azo-t-butane, it would not be necessary to add toluene; pentane would simply be distilled off to leave the pure product.

EXAMPLE 3

Using the procedure of preceding Example 1, the following compounds are prepared from the indicated starting material;

| Azo Compound | Starting Material |
|---|---|
| azobisethane | acetaldehyde |
| azo-n-propane | propionaldehyde |
| azo-n-butane | butyraldehyde |
| azo-sec-butane | methylethylketone |
| azo-iso-butane | isobutyraldehyde |
| azo-n-pentane | pentanaldehyde |
| 2,2'-azo-n-pentane | methyl-n-propylketone |
| 3,3'-azo-n-pentane | diethylketone |
| 1,1'-azo-(2,2-dimethylpropane) | 2,2-dimethylpropionaldehyde |
| azo-n-hexane | hexaldehyde |

EXAMPLE 4

Using the procedure of preceding Example 2, the following compounds are prepared from the indicated starting material:

| Azo Compound | Starting Material |
|---|---|
| azo-t-butane | t-butylamine |
| 1,1'-azo-(1,1-dimethylbutane) | 1,1-dimethyl-1-aminobutane |
| azo-1,1'-bis(1,1-dimethylprop-2-ene) | 1,1-dimethyl-1-aminoprop-2-ene |
| azobenzene | aniline |
| 1,1'azo-(2-methylbenzene) | 2-methylaniline |
| 1,1'-azo-(4-t-butylbenzene) | 4-t-butylaniline |
| azo-isobutyronitrile | 2-amino-2-cyanopropane |

EXAMPLE 5

Using the general procedure of preceding Example 1, asymmetrical azo compounds are prepared by reacting equimolar proportions of a carbonyl compound and hydrazine, to preferentially form the adduct of one hydrazine molecule and one carbonyl-containing molecule. This adduct is isolated and reacted with a second carbonyl compound, then is reduced with lithium aluminum hydride and oxidized with mercuric oxide to form the desired azo compound. Examples of compounds prepared, and their respective starting materials, are as follows:

| Azo Compound | Starting Materials |
|---|---|
| ethyl-azo-n-butane | acetaldehyde butyraldehyde |
| 2-(n-butyl)-azo-2'-n-propane | methylethylketone acetone |

EXAMPLE 6

Using the general procedure of preceding Example 2, asymmetrical azo compounds are prepared by reacting a mixture of two amines with sulfuryl chloride, separating the desired sulfamide, and reacting to form the azo compound. Examples of compounds prepared, and their respective starting materials, are as follows:

| Azo Compound | Starting Materials |
|---|---|
| t-butyl-azo-n-propane | t-butylamine n-propylamine |

-continued

| Azo Compound | Starting Materials |
|---|---|
| t-butyl-azo-isopropane | 5-butylamine 2-aminopropane |

EXAMPLE 7

An experiment is performed to assess the cetane number improvement from adding azo compounds to diesel fuel.

A commercial No. 2 diesel fuel is obtained and portions are blended with desired amounts of various additives. The fuels so prepared, and the original, unblended fuel, are used in a standard test engine, according to the ASTM Test for Ignition Quality of Diesel Fuels by the Cetane Method (D613).

Results are obtained as summarized below, where "Cetane Number Increase" is calculated by subtracting the cetane number obtained with the original, unblended fuel from the cetane number obtained with the additive-containing fuel:

| Additive | | Cetane Number |
|---|---|---|
| Compound | Wt. % | Increase |
| azobisethane | 0.8 | 1 |
| azo-n-propane | 1.0 | 5 |
| azo-iso-propane | 1.0 | 7 |
| azo-t-butane | 1.0 | 4 |
| azo-1,1'-bis(1,1,dimethylprop-2-yne) | 1.0 | 3 |

Considerable cetane number enhancement is obtained with the additives.

EXAMPLE 8

One compound, azo-t-butane, is selected for an experiment to determine the effect of additive concentration upon cetane number increase. Various amounts of the compound are blended with a commercial No. 2 diesel fuel and the mixtures are tested, as in the preceding example. Results are as summarized below:

| Additive Wt. % | Cetane Number Increase |
|---|---|
| 0.1 | 1 |
| 0.5 | 2 |
| 1.0 | 4 |
| 2.0 | 6 |

While various specific embodiments and modifications of this invention have been described in the foregoing specification, further modifications will be apparent to those skilled in the art. Such further modifications are included within the scope of this invention as defined by the following claims.

What is claimed is:

1. A composition comprising a liquid hydrocarbon fuel and at least one azo compound having the formula:

$$R_1N{=}NR_2$$

wherein $R_1$ and $R_2$ are the same or different hydrocarbon organo groups selected from the group consisting of acyclic groups and alicyclic groups.

2. The composition defined in claim 1, wherein the fuel is suitable for use in a diesel engine.

3. The composition defined in claim 1, wherein at least one of the organo groups is an acyclic group.

4. The composition defined in claim 1, wherein at least one of the organo groups is an alicyclic group.

5. The composition defined in claim 1, wherein $R_1$ and $R_2$ are the same groups.

6. The composition defined in claim 1, wherein $R_1$ and $R_2$ are different groups.

7. The composition defined in claim 1, wherein more than one azo compound is present.

8. The composition defined in claim 1, including at least about 0.05 weight percent azo compound.

9. The composition defined in claim 1, wherein azo compound comprises about 0.05 to about 10 percent by weight.

10. The composition defined in claim 1, wherein azo compound comprises about 0.05 to about 5 percent by weight.

11. The composition defined in claim 1, wherein azo compound comprises about 0.1 to about 2 percent by weight.

12. The composition defined in claim 1, wherein an azo compound comprises azobisethane.

13. The composition defined in claim 1, wherein an azo compound comprises azo-n-propane.

14. The composition defined in claim 1, wherein an azo compound comprises azo-iso-propane.

15. The composition defined in claim 1, wherein an azo compound comprises azo-t-butane.

16. The composition defined in claim 1, wherein an azo compound comprises azo-1,1'-bis(1,1,dimethylprop-2-yne).

17. A composition comprising a diesel fuel and at least one azo compound having the formula:

$$R_1N{=}NR_2$$

wherein $R_1$ and $R_2$ are the same or different hydrocarbon organo groups, each containing 1 to about 10 carbon atoms and selected from the group consisting of acyclic groups and alicyclic groups.

18. The composition defined in claim 17, wherein $R_1$ and $R_2$ are the same groups.

19. The composition defined in claim 17, wherein $R_1$ and $R_2$ are different groups.

20. The composition defined in claim 17, wherein more than one azo compound is present.

21. The composition defined in claim 17, wherein the azo compound comprises about 0.05 to about 10 percent by weight.

22. The composition defined in claim 17, wherein the azo compound comprises about 0.05 to about 5 percent by weight.

23. The composition defined in claim 17, wherein the azo compound comprises about 0.1 to about 2 percent by weight.

24. A composition comprising a liquid hydrocarbon middle distillate fuel and about 0.05 to about 10 percent by weight of at least one azo compound having the formula:

$$R_1N{=}NR_2$$

wherein $R_1$ and $R_2$ are the same or different hydrocarbon organo groups, each containing 1 to about 10 carbon atoms and selected from the group consisting of acyclic groups and alicyclic groups.

25. The composition defined in claim 24, wherein $R_1$ and $R_2$ are the same groups.

26. The composition defined in claim 24, wherein $R_1$ and $R_2$ are different groups.

27. The composition defined in claim 24, wherein more than one azo compound is present.

28. The composition defined in claim 24, wherein the azo compound comprises about 0.05 to about 5 percent by weight.

29. The composition defined in claim 24, wherein the azo compound comprises about 0.1 to about 2 percent by weight.

30. A method for increasing the cetane number of a liquid hydrocarbon fuel, comprising adding to the fuel at least about 0.05 percent by weight of at least one azo compound having the formula:

$$R_1N{=}NR_2$$

wherein $R_1$ and $R_2$ are the same or different hydrocarbon organo groups, each containing 1 to about 10 carbon atoms and selected from the group consisting of acyclic groups, and alicyclic groups.

31. The method defined in claim 30, wherein the fuel is a diesel fuel.

32. The method defined in claim 30, wherein the azo compound is dissolved in the fuel.

33. The method defined in claim 30, wherein the azo compound is dissolved in a consolvent, which is soluble in the fuel.

34. The method defined in claim 30, wherein more than one azo compound is added.

35. The method defined in claim 30, wherein $R_1$ and $R_2$ are the same groups.

36. The method defined in claim 30, wherein $R_1$ and $R_2$ are different groups.

37. The method defined in claim 30, wherein the azo compound comprises about 0.05 to about 10 percent by weight.

38. The method defined in claim 30, wherein the azo compound comprises about 0.05 to about 5 percent by weight.

39. The method defined in claim 30, wherein the azo compound comprises about 0.1 to about 2 percent by weight.

40. A method for operating an engine, comprising supplying the engine with a fuel comprising the composition of claim 1.

41. The composition defined in claim 24, wherein there is added to the fuel about 0.1 to about 2 percent by weight azo-n-propane.

42. The composition defined in claim 24, wherein there is added to the fuel about 0.1 to about 2 percent by weight azo-iso-propane.

43. The composition defined in claim 24, wherein there is added to the fuel about 0.1 to about 2 percent by weight azo-t-butane.

44. The composition defined in claim 24, wherein there is added to the fuel about 0.1 to about 2 percent by weight azo-1,1'-bis(1,1-dimethylprop-2-yne).

* * * * *